US012012685B2

(12) United States Patent
Santarossa et al.

(10) Patent No.: US 12,012,685 B2
(45) Date of Patent: Jun. 18, 2024

(54) LAUNDRY APPLIANCE COMPRISING A DRAWER POSITION DETECTING SYSTEM

(71) Applicant: Electrolux Appliances Aktiebolag, Stockholm (SE)

(72) Inventors: Alberto Santarossa, Porcia (IT); Paolo Driussi, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 776 days.

(21) Appl. No.: 17/270,582

(22) PCT Filed: Aug. 23, 2019

(86) PCT No.: PCT/EP2019/072614

§ 371 (c)(1),
(2) Date: Feb. 23, 2021

(87) PCT Pub. No.: WO2020/043622

PCT Pub. Date: Mar. 5, 2020

(65) Prior Publication Data

US 2021/0388553 A1 Dec. 16, 2021

(30) Foreign Application Priority Data

Aug. 30, 2018 (EP) ..... 18191666

(51) Int. Cl.
*D06F 34/20* (2020.01)
*D06F 23/02* (2006.01)
(Continued)

(52) U.S. Cl.
CPC ..... *D06F 34/20* (2020.02); *D06F 23/02* (2013.01); *D06F 33/37* (2020.02); *D06F 33/47* (2020.02);
(Continued)

(58) Field of Classification Search
CPC ..... D06F 34/20
See application file for complete search history.

(56) References Cited

U.S. PATENT DOCUMENTS 8,875,548 B2 11/2014 Hendrickson
9,271,627 B2 3/2016 Alexander et al.

FOREIGN PATENT DOCUMENTS

DE 102011051797 A1 3/2012
EP 3249091 A1 11/2017
EP 3267144 A1 1/2018

OTHER PUBLICATIONS

International Search Report and Written Opinion for International Application No. PCT/EP2019/072614, dated Oct. 21, 2019, 10 pages.

*Primary Examiner* — Jason Y Ko
(74) *Attorney, Agent, or Firm* — Bradley Arant Boult Cummings LLP

(57) ABSTRACT

A laundry appliance having a cabinet accommodating a laundry treatment chamber, a storage drawer comprising at least one compartment for containing laundry treatment agent and a drawer seat slidingly housing the storage drawer such that the storage drawer is slidable between a retracted position, in which the storage drawer is retracted inside the drawer seat, and an extracted position, in which the storage drawer is at least partially extracted from the drawer seat. The laundry appliance further comprises a drawer position detecting system for detecting when the drawer is in the retracted position. The drawer position detecting system comprises a target element on one of the cabinet and the drawer, and a sensor element on the other of the cabinet and the drawer. The detecting system is configured to sense a proximity of the target element to the sensor element.

15 Claims, 9 Drawing Sheets

(51) Int. Cl.

| | |
|---|---|
| ***D06F 33/37*** | (2020.01) |
| ***D06F 33/47*** | (2020.01) |
| ***D06F 39/02*** | (2006.01) |
| *D06F 105/42* | (2020.01) |
| *D06F 105/54* | (2020.01) |
| *D06F 105/62* | (2020.01) |

(52) U.S. Cl.
CPC ..... *D06F 39/02* (2013.01); *D06F 39/022* (2013.01); *D06F 2105/42* (2020.02); *D06F 2105/54* (2020.02); *D06F 2105/62* (2020.02)

LAUNDRY APPLIANCE COMPRISING A DRAWER POSITION DETECTING SYSTEM

This application is a U.S. National Phase application of PCT International Application No. PCT/EP2019/072614, filed Aug. 23, 2019, which claims the benefit of European Application No. 18191666.9, filed Aug. 30, 2018, both of which are incorporated by reference herein.

FIELD OF THE INVENTION

The present invention relates to the field of laundry treatment appliances (hereinafter, concisely, "laundry appliances"), and particularly to laundry appliances for treating, e.g. washing, items (such as linen, clothes, garments, shoes, and the like), such as laundry washing machines and laundry washing machines also implementing laundry drying functions (also referred to as washers/dryers).

BACKGROUND OF THE INVENTION

In order to perform washing cycles (e.g., comprising washing, rinsing and draining phases) on laundry located in the laundry treatment chamber of a laundry appliance, water and laundry treatment agents (such as liquid and powder treatment agents) should be fed into the laundry treatment chamber in a controlled way during the various phases of the washing cycles.

For this reason, a laundry appliance typically comprises a drawer having drawer compartments for containing one or more of said laundry treatment agents. The laundry is configured to deliver selected amounts of such laundry treatment agents contained in the drawer compartments into the laundry treatment chamber, mixed with proper amounts of water.

In addition to, or in the place of drawer compartments adapted to contain a single dose of a respective laundry treatment agent for performing a single washing cycle (hereinafter referred to as single-dose compartments), in an increasingly common type of laundry appliance, the drawer comprises one or more compartments each one adapted to contain multiple doses of a respective treatment agent for performing multiple washing cycles (hereinafter referred to as multi-dose compartments). Just as an example, in case of two multi-dose compartments, a multi-dose compartment may be arranged to contain multiple doses of a liquid washing detergent, whereas the other multi-dose compartment may be arranged to contain multiple doses of a liquid softener. In this class of laundry appliance, the laundry appliance may implement an auto-dosing functionality in which, at each washing cycle (and when the auto-dosing functionality is enabled), a predetermined amount of treatment agent is automatically taken (e.g., by means of a pumping apparatus) from the multi-dose compartment(s) and dispensed to the laundry treatment chamber through proper channels together with water supplied by a water distribution system of the laundry appliance.

The laundry appliance is usually equipped with a drawer seat for slidingly housing the drawer within it between retracted and extracted positions.

By retracted position, it is intended a position in which the drawer is retracted inside the drawer seat. Such retracted position corresponds to an operative condition of the drawer, which allows laundry treatment agent to be taken from the correct compartment and to be fed into the laundry treatment chamber together with water provided by the water distribution system.

For example, the retracted position of the drawer corresponds to an operative condition of the drawer in which:

- outputs of the compartments of the drawer are in fluid communication with the laundry treatment chamber;
- the mutual position between the water distribution system and the mono-dose compartments is such to allow the former to flood the latter with water;
- the pumping apparatus is able to take a dose of laundry treatment agent stored in the multi-dose compartments, and provide it to the laundry treatment chamber together with water supplied by the water distribution system.

By extracted position it is intended a position of the drawer in which the drawer is at least partially extracted from the drawer seat. Usually, but not necessarily, a drawer in the extracted position protrudes from the cabinet of the laundry appliance. Unlike the retracted position, the extracted position does not correspond to an operative condition, because at least one of the following condition is verified:

- outputs of the compartments of the drawer are not in fluid communication with the laundry treatment chamber, or at least they are only partially in fluid communication therewith;
- the water distribution system is not aligned with the mono-dose compartments;
- the pumping apparatus is unable to take a dose of laundry treatment agent stored in the multi-dose compartments, and is unable to provide it to the laundry treatment chamber together with water supplied by the water distribution system.

SUMMARY OF INVENTION

Applicant has realized that being able to detect the position of the drawer, and particularly to distinguish between the retracted and the extracted positions, would be very advantageous, since it would allow to increase the efficiency of the laundry appliance and reduce the occurrence of faults and incorrect washing cycle operations. Indeed, if the running of a washing cycle is triggered when the drawer is not in the retracted position, the washing cycle cannot be performed in a correct way. For example, water supplied by the water distribution system cannot be provided to the correct compartments, laundry treatment agent stored in the multi-dose compartments cannot be taken by the pumping apparatus (or the pumping apparatus itself is prevented to correctly operate). Moreover, laundry treatment agent may be improperly introduced in the laundry treatment chamber at an early phase of the washing cycle, or water and/or laundry treatment agent may wrongly gather at the bottom of the drawer seat or in other parts of the laundry appliance without reaching the laundry treatment chamber, potentially causing faults and failures of the laundry appliance. Furthermore, laundry treatment agent and/or water may splash to outside to contaminate the surroundings.

In view of the above, in order to avoid the abovementioned drawbacks, Applicant has devised a drawer position detecting system for detecting when the position of the drawer is in the retracted position, which is at the same time efficient, cost effective, simple to be implemented, easily operable, and that is suitable to be easily installed on a laundry appliance.

Having the knowledge of the actual position of the drawer could be advantageously used to avoid that a washing cycle is carried out when the drawer is in the extracted position, preventing thus the abovementioned drawbacks.

Applicant has found that by providing a drawer position detecting system comprising a target element and a sensor element configured to sense the proximity of the target element to the sensor element, and by installing one between the target element and the sensor element on the storage drawer, and the other one on the cabinet of the laundry appliance, it is possible to easily distinguish between the retracted and extracted positions of the drawer without having to install expensive, complicated and prone to fault detection systems.

One or more aspects of the present invention are set out in the independent claims, with advantageous features of the same invention that are indicated in the dependent claims.

An aspect of the present invention relates to a laundry appliance comprising a cabinet accommodating a laundry treatment chamber and a storage drawer comprising at least one compartment for containing laundry treatment agent.

According to an embodiment of the present invention, the cabinet comprises a drawer seat for slidingly housing the storage drawer.

According to an embodiment of the present invention, the storage drawer is configured to slide with respect to the drawer seat between:

- a retracted position, in which the storage drawer is retracted inside the drawer seat, and
- an extracted position, in which the storage drawer is at least partially extracted from the drawer seat.

According to an embodiment of the present invention, the laundry appliance further comprises a drawer position detecting system for detecting when the storage drawer is in the retracted position.

According to an embodiment of the present invention, said drawer position detecting system comprises a target element and a sensor element configured to sense a proximity of the target element to the sensor element.

According to an embodiment of the present invention, a first element between said target element and said sensor element is located on the storage drawer and a second element between said target element and said sensor element different than said first element is located on the cabinet.

According to an embodiment of the present invention, when the storage drawer is in the extracted position, the storage drawer protrudes from the cabinet.

According to an embodiment of the present invention, said second element is located on the drawer seat.

According to an embodiment of the present invention, the drawer position detecting system is configured to assess that the storage drawer is in the retracted position when the sensor element senses that the target element is in proximity to the sensor element.

According to an embodiment of the present invention, the drawer position detecting system is configured to assess that the storage drawer is in the retracted position when the sensor element senses that the distance between the target element and the sensor element corresponds to a predefined distance.

According to an embodiment of the present invention the laundry appliance comprises a blocking system adapted to block in a releasable manner the drawer in the retracted position.

According to an embodiment of the present invention, the drawer position detecting system is configured so that the sensor element is arranged to sense that the distance between the target element and the sensor element corresponds to the predefined distance when the blocking system is blocking the drawer in the retraced position.

According to an embodiment of the present invention, said blocking system comprises a first locking member located on the storage drawer and adapted to engage in a releasable way a corresponding second locking member located on the drawer seat when the storage drawer is in the retracted position, and disengage from the second locking member when the storage drawer is not in the retracted position.

According to an embodiment of the present invention, the drawer position detecting system is configured so that the sensor element is arranged to sense that the distance between the target element and the sensor element corresponds to the predefined distance when the first locking member is engaged with the second locking member.

According to an embodiment of the present invention, said sensor element is a magnetic sensor and said target element is a magnet.

According to an embodiment of the present invention, said at least one compartment is adapted to contain multiple doses of the laundry treatment agent for performing multiple washing cycles.

According to an embodiment of the present invention, the laundry appliance comprises a pumping system configured to take at least one dose of the laundry treatment agent from the at least one container and deliver it to the laundry treatment chamber.

According to an embodiment of the present invention, the pumping system comprises at least one pump actuation part housed in a pump housing located on a rear portion of the storage drawer.

According to an embodiment of the present invention, the pumping system comprises at least one pump electric motor, located on a rear portion of the drawer seat so that, when the storage drawer is in the retracted position, the at least one pump electric motor is adapted to mechanically couple with the at least one pump actuation part for allowing the pump actuation part to be driven.

According to an embodiment of the present invention, said first element is located at the pump housing.

According to an embodiment of the present invention, said second element is located on the pump electric motor.

According to an embodiment of the present invention, the at least one pump electric motor is preferably housed in a motor shell, and the second element is preferably located at the motor shell.

According to an embodiment of the present invention, the at least one pump actuation part is driven by the at least one pump electric motor through the rotation of a shaft provided on said pump electric motor, said shaft being suitable to be connected to a rotor of the pump actuation part once the drawer is in the retracted position.

According to an embodiment of the present invention, the laundry appliance further comprises a washing cycle control system configured to trigger the running of washing cycles in response to a command submitted by an user of the laundry appliance.

According to an embodiment of the present invention, the laundry appliance further comprises a stand-by system configured to prevent the running of a washing cycle triggered by the washing cycle control system when the drawer position detecting system detects that the storage drawer is in the extracted position.

According to an embodiment of the present invention, the stand-by system is configured to stop an already running washing cycle when the drawer position detecting system detects that the storage drawer is in the extracted position.

According to an embodiment of the present invention, the stand-by system is further configured to generate an acoustic and/or visual alert when the drawer position detecting system detects that the position of the storage drawer is in the extracted position.

According to an embodiment of the present invention, said at least one compartment comprises two compartments each one adapted to contain multiple doses of the laundry treatment agent for performing multiple washing cycles.

According to an embodiment of the present invention, the storage drawer further comprises at least one further compartment adapted to contain a single dose of a respective laundry treatment agent for performing a single washing cycle.

Another aspect of the present invention relates to a method for operating a laundry appliance.

According to an embodiment of the present invention, the laundry appliance comprises a cabinet accommodating a laundry treatment chamber for receiving laundry to be treated according to at least one washing cycle, and a storage drawer comprising at least one compartment for containing laundry treatment agent to be used in said at least one washing cycle.

According to an embodiment of the present invention, the cabinet comprises a drawer seat for slidingly housing the storage drawer.

According to an embodiment of the present invention, the storage drawer is configured to slide with respect to the drawer seat between:

- a retracted position, in which the storage drawer is retracted inside the drawer seat, and
- an extracted position, in which the storage drawer is at least partially extracted from the drawer seat, According to an embodiment of the present invention, the method comprises providing a drawer position detecting system for detecting when the storage drawer is in the retracted position.

According to an embodiment of the present invention, said drawer position detecting system comprises a target element and a sensor element configured to sense a proximity of the target element to the sensor element.

According to an embodiment of the present invention, a first element between said target element and said sensor element is located on the storage drawer and a second element between said target element and said sensor element different than said first element is located on the cabinet.

According to an embodiment of the present invention, the method comprises detecting when the storage drawer is in the retracted position by exploiting said drawer position detecting system.

According to an embodiment of the present invention, the method further comprises, when the drawer position detecting system detects that the storage drawer is in the extracted position, having the laundry appliance enter in a stand-by condition in which washing cycles are inhibited.

According to an embodiment of the present invention, the method comprises the following phases:

- having the laundry appliance run a washing cycle for treating laundry contained in the laundry treatment chamber in response to a trigger by a user;
- having the laundry appliance enter in the stand-by condition conditioned to the detection of the storage drawer in the extracted position by the drawer position detecting system;
- having the laundry appliance stop said running washing cycle conditioned to the entering of the laundry appliance into the stand-by condition.

According to an embodiment of the present invention, the method further comprises the following phases:

- having the laundry appliance enter in the stand-by condition conditioned to the detection of the storage drawer in the extracted position by the drawer position detecting system;
- having the laundry appliance prevent the running of a washing cycle for treating laundry contained in the laundry treatment chamber triggered by a user.

According to an embodiment of the present invention, the method further comprises, when the drawer position detecting system detects that the storage drawer is in the retracted position, having the laundry appliance enter in an operative condition in which washing cycles are allowed to run.

According to an embodiment of the present invention, the method further comprises the following phases:

- having the laundry appliance to switch from the stand-by condition to the operative condition conditioned to the detection of a passage of the storage drawer from the extracted position to the retracted position by the drawer position detecting system;
- having the laundry appliance start the running of a washing cycle for treating laundry contained in the laundry treatment chamber triggered by a user.

According to an embodiment of the present invention, the method further comprises generating an acoustic and/or visual alert when the laundry appliance is in the stand-by condition.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein.

DETAILED DESCRIPTION OF PREFERRED EMBODIMENTS OF THE INVENTION

Figure 1A:
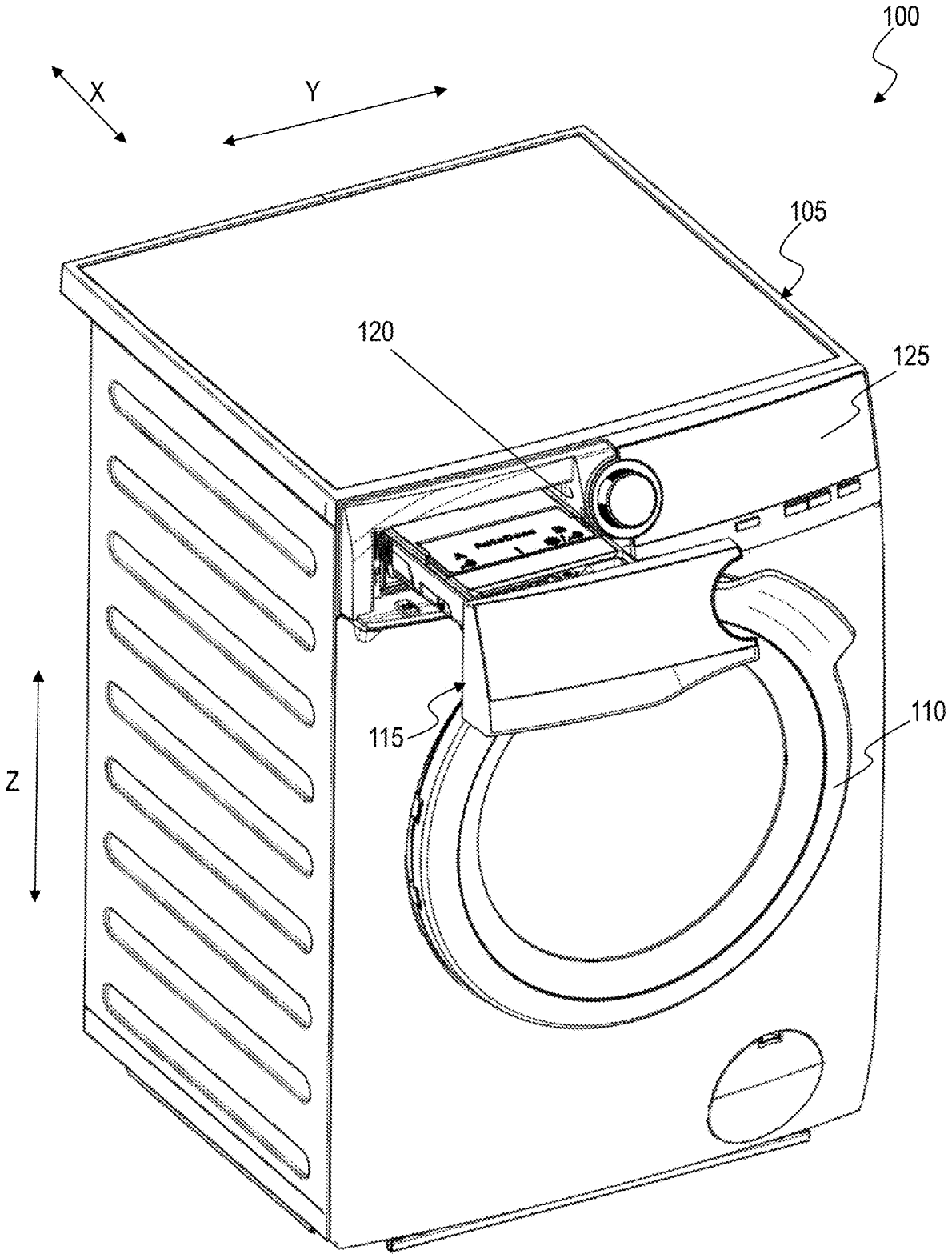
FIGS. 1A and 1B show perspective views of a laundry appliance according to an embodiment of the present invention.
Figure 1B:
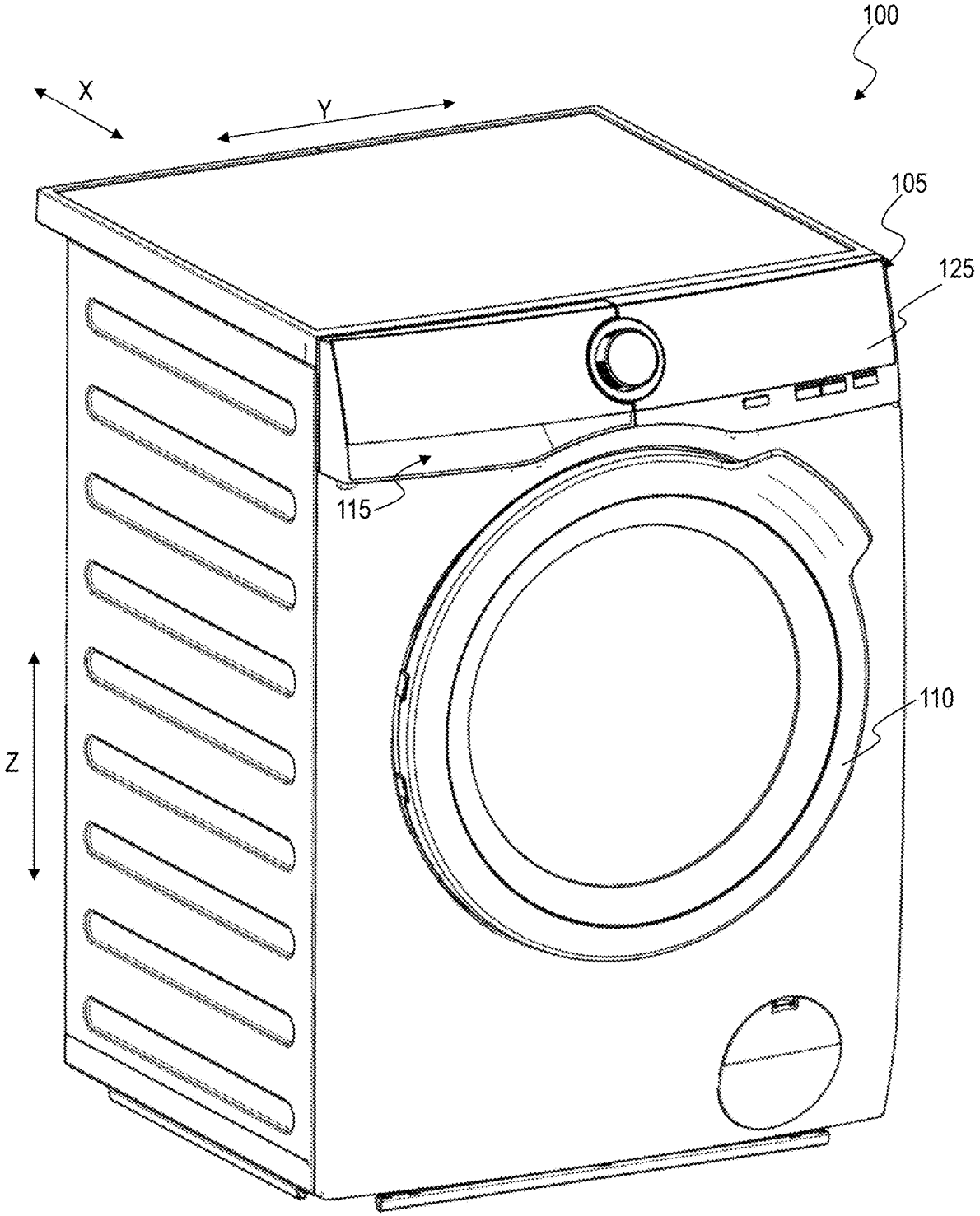

With reference to the drawings, sharing the same reference system identified by the three orthogonal directions x, y and z, FIGS. 1A and 1B show perspective views of a laundry appliance 100 according to an embodiment of the present invention. According to the exemplary, not limiting, embodiment herein considered, the laundry appliance 100 is a washing machine. In any case, although in the following description explicit reference will be made to a washing machine, this should not to be construed as a limitation; indeed, the present invention applies to other types of laundry appliances (for example combined washers/dryers, i.e. washing machines also having laundry drying functions). In operation, the laundry appliance 100 rests on a rest surface, such as the floor, parallel to directions x and y, and uprightly extends from it along direction z.

The laundry appliance 100 comprises a (e.g., parallepiped-shaped) cabinet 105, which preferably accommodates a laundry treatment chamber (i.e., a laundry washing chamber in the example herein considered of a washing machine) for performing a laundry treatment cycle on items housed therein (i.e., a washing cycle on a laundry load in the example herein considered of a washing machine).

The laundry treatment chamber (also simply referred to as treatment chamber) preferably comprises a washing tub (not shown) and, within it, a (e.g., rotatable) washing basket or drum (not shown) adapted to contain the laundry load to be washed. A cabinet front has a loading opening providing an access to the drum for loading/unloading the laundry load, a door 110 (shown in a closed position in FIGS. 1A and 1B) being provided for sealably closing the loading opening during the operation of the laundry appliance 100.

Although not shown, the laundry appliance 100 also comprises, enclosed in the cabinet 105, electrical/electronic/mechanical/hydraulic components for the operation of the laundry appliance 100 (such as for example motor, electromechanical valves, pumps and impellers of the hydraulic apparatus, one or more heating elements for heating water/treatment agents/air).

The laundry appliance 100 is advantageously equipped with a laundry appliance control system (not visible in FIGS. 1A and 1B) comprising control units, power supply modules, driving units, power regulators and generally all the electric and electronic components which are responsible for the driving, control, and supply of the electrical/electronic/mechanical/hydraulic components of the laundry appliance 100. Preferably, at least part of said laundry appliance control system is located on one or more dedicated electronic boards, for example located on the top part of the cabinet.

The laundry appliance 100 further comprises a storage drawer 115 (briefly, or, concisely, drawer) for containing one or more laundry treatment agents (or, concisely, treatment agents), such as liquid and powder treatment agents including, but not limited to, washing detergents, rinsing detergents, bleaches and softeners. The cabinet 105 comprises a drawer seat 120 (preferably provided on a top part of a cabinet front) for housing the drawer 115, the drawer being advantageously adapted to slide within the drawer seat 120, along a longitudinal or sliding direction, between an extracted position (shown in FIG. 1A) and a retracted position (shown in FIG. 1B). The sliding direction is for example parallel to direction x, or may be slightly slanted with respect thereto.

As already mentioned in the introduction, by retracted position of the drawer 115 it is intended a position in which the drawer 115 is (fully) retracted inside the drawer seat 120 (as in the situation illustrated in FIG. 1B), while by extracted position of the drawer 115, it is intended a position in which the drawer 115 is at least partially extracted from the drawer seat 120 and preferably, but not necessarily, protrudes from the cabinet 105 (as in the situation illustrated in FIG. 1A).

Preferably, the laundry appliance 100 further comprises a user interface 125, the user interface 125 being preferably provided on the top part of the cabinet front, more preferably next to the drawer seat 120 along direction y.

Preferably, although not necessarily, the user interface 125 comprises a display unit, not shown, for visually displaying one or more pieces of information; the display unit may for example be a light emitting polymer display (LPD), a liquid crystal display, a thin film transistor-liquid crystal display, or an organic light-emitting diode display.

The user interface 125 preferably comprises one or more control elements (e.g., selection buttons and/or knobs) for allowing the user to select a washing cycle and to control one or more operating parameters of the selected washing cycle (including, but not limited to, temperature, laundry load dirt level, spin speed, start time delay, drawer compartment selection, treatment agent selection).

Additionally, as herein exemplary assumed, or alternatively, the user interface 125 preferably comprises one or more status indicators for indicating to the user a status of the laundry appliance 100; the status indicators may be configured to indicate a status of one or more components of the laundry appliances 100 and/or a status of the washing cycle (including, but not limited to, information about a residual time to the end of the ongoing washing cycle, and/or information about a current phase of the ongoing washing cycle, and/or selected parameters for the ongoing washing cycle, and/or selected drawer compartment, and/or selected treatment agent).

Figure 2A:
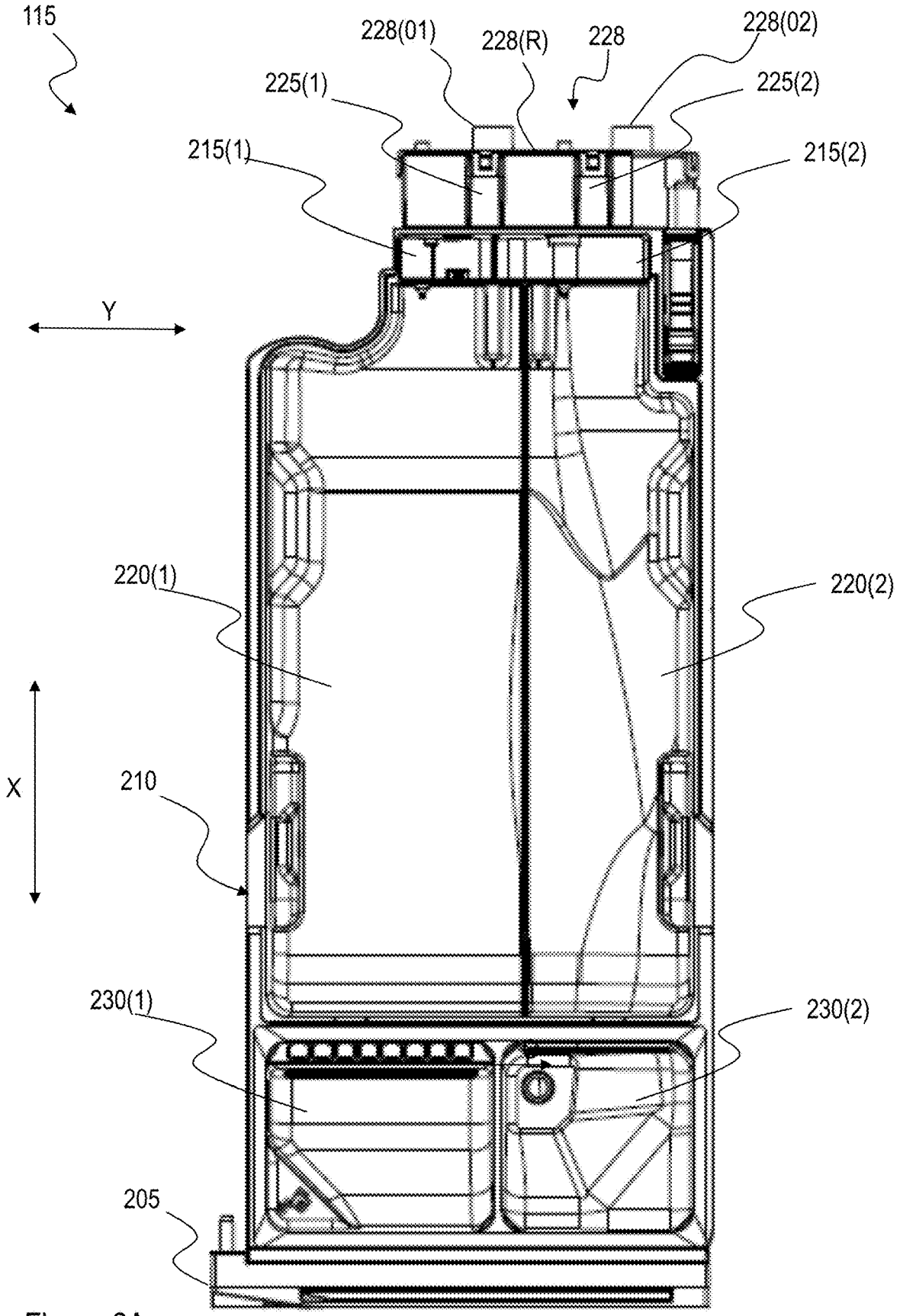
FIG. 2A shows a top view of a drawer of the laundry appliance according to an embodiment of the present invention.
Figure 2B:
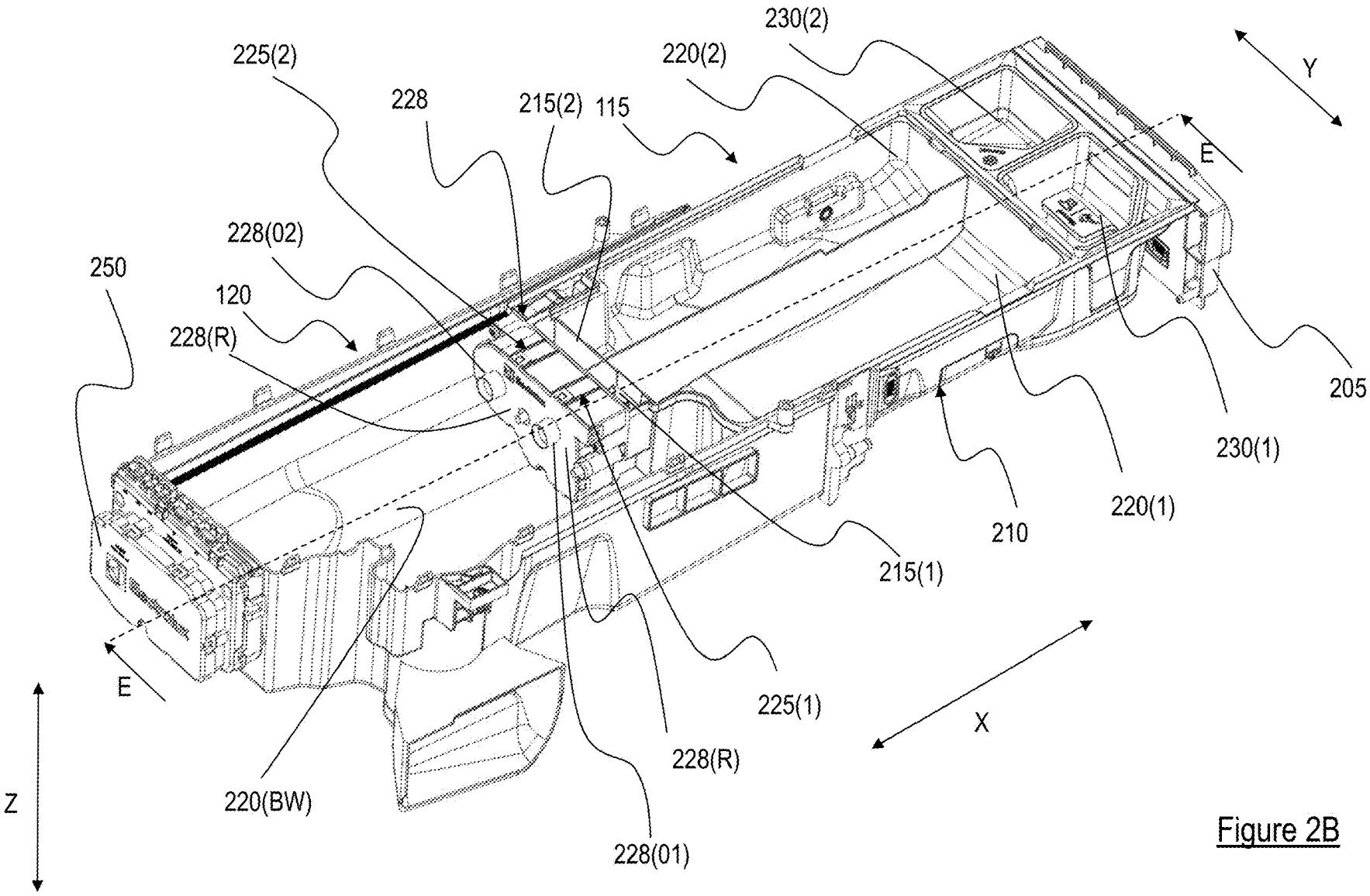
FIG. 2B shows a perspective view of the drawer of FIG. 2A in an extracted position within a drawer seat, according to an embodiment of the present invention.
Figure 2C:
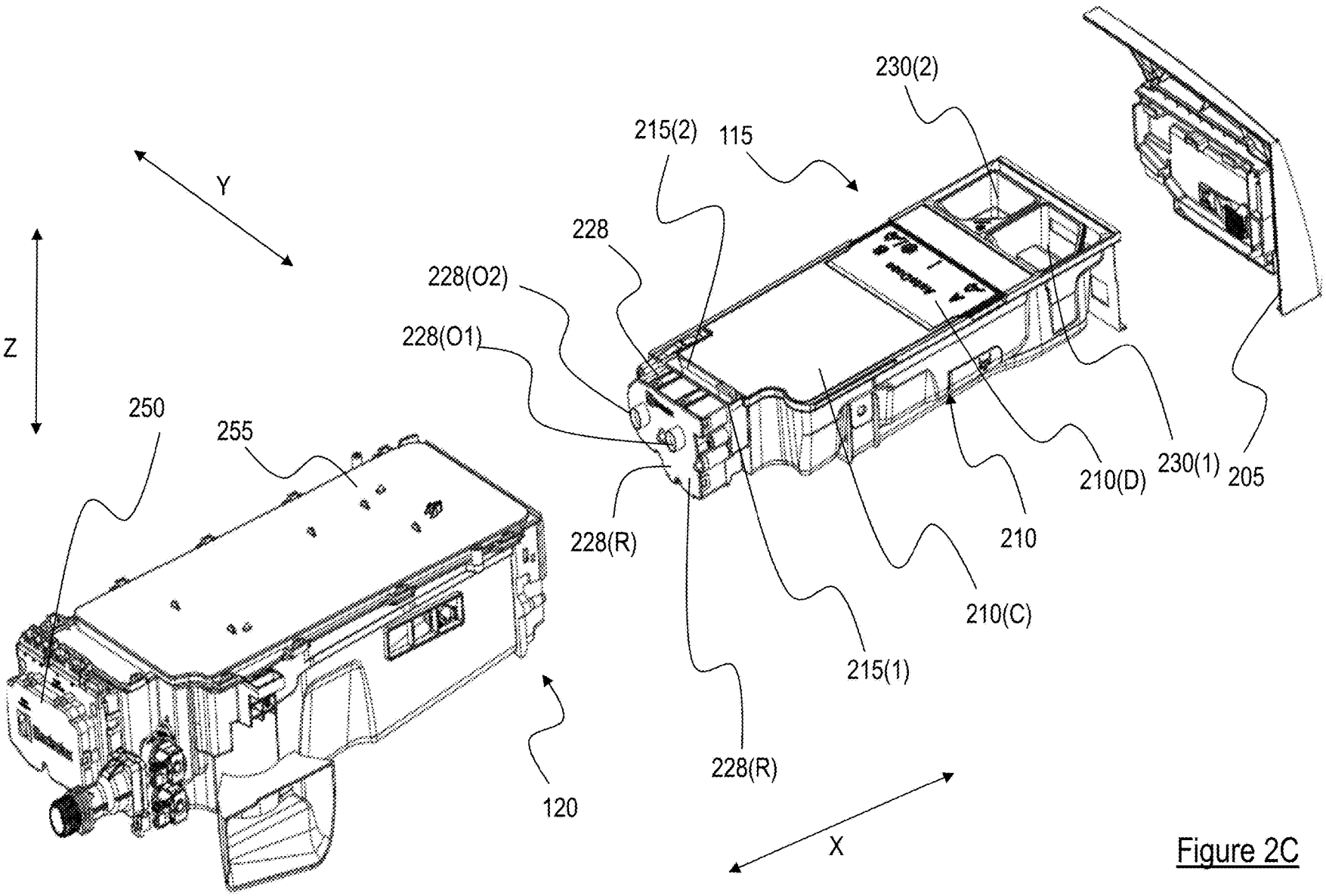
FIG. 2C shows a perspective and partially exploded view from behind of the drawer of FIGS. 2A and 2B and of the drawer seat of FIG. 2B, according to an embodiment of the present invention.
Figure 2D:
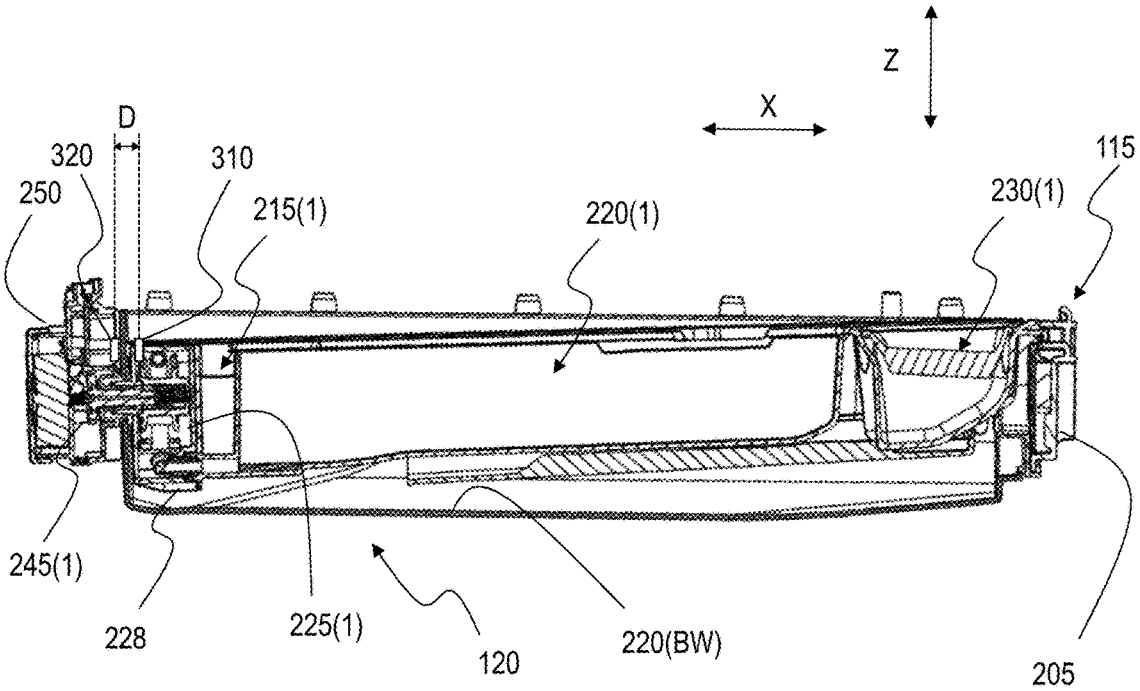
FIG. 2D shows a sectional view of the drawer along the section line E-E line of FIG. 2B when the drawer is in a retracted position.
Figure 2E:
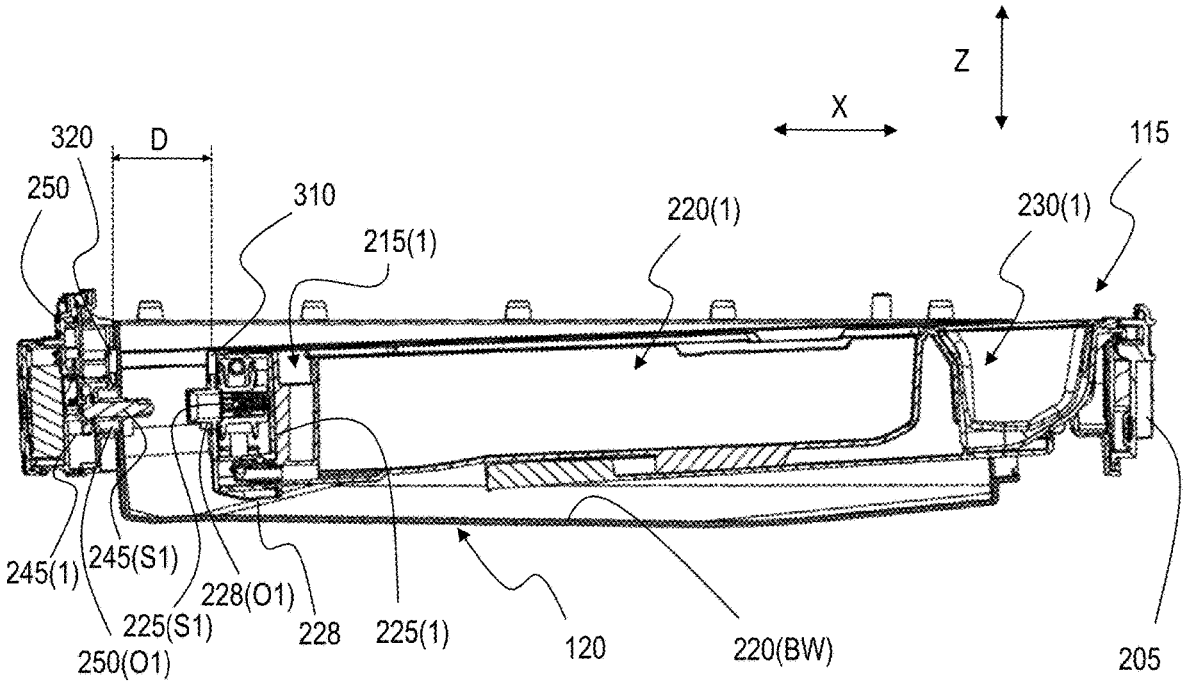
FIG. 2E shows a sectional view of the drawer along the section line E-E line of FIG. 2B when the drawer is in an extracted.

With reference now also to FIG. 2A, it shows a top view of the drawer 115 according to an embodiment of the present invention. For ease of description, FIG. 2A will be discussed together with FIG. 2B, which shows a perspective view of the drawer 115 in the extracted position, wherein the drawer 115 is partially extracted from the drawer seat 120, with FIG. 2C, which shows a perspective and partially exploded view from behind of the drawer 115 and of the drawer seat 120, and with FIGS. 2D, 2E, which show section views of the drawer 115 housed in the drawer seat 120 along a plane parallel to directions x and z and passing through section line E-E depicted in FIG. 2B (wherein FIG. 2D shows the drawer 115 in the retracted position, while FIG. 2E shows the drawer in the extracted position).

The drawer 115 preferably comprises a drawer handle 205 allowing the user to slidably move the drawer 115 between the extracted position and the retracted position when it is fitted in the drawer seat 120, and a drawer body 210 to which the drawer handle 205 is adapted to be mounted or coupled or connected (for example, in a removable or reversible way). When the laundry appliance 100 is installed and the drawer 115 is fitted in the drawer seat 120, the drawer handle 205 preferably identifies, along direction x, a drawer front (which advantageously forms part of the cabinet front when the drawer 115 is in the retracted position).

The drawer 115 preferably comprises, along direction x (from the drawer front backwards):

behind the handle 205, and hence in the drawer body 210, one or more (two, in the example at issue) drawer compartments 220(1),220(2) each one adapted to contain multiple doses of a respective treatment agent for performing multiple washing cycles, hereinafter referred to as multi-dose compartments 220(1),220(2). Therefore, the exemplary considered laundry appliance 100 is configured to implement an auto-dosing functionality in which, at each washing cycle (and when the auto-dosing functionality is enabled), a predetermined amount of treatment agent is automatically taken (e.g. by means of a pumping system, discussed in the following) from one or both of the multi-dose compartments 220(1),220(2). Just as an example, the multi-dose compartment 220(1) may be arranged to contain multiple doses of a liquid washing detergent, whereas the multi-dose compartment 220(2) may be arranged to contain multiple doses of a liquid softener;

behind the multi-dose compartments 220(1),220(2), and hence in the drawer body 210, one or more (two, in the example at issue) channels 215(1),215(2) associated with the multi-dose compartments 220(1),220(2) (in the example herein considered, each channel 215(1), 215(2) is associated with a respective one of the multi-dose compartments 220(1),220(2), the channel 215(1) being for example associated with the multi-dose compartment 220(1) and the channel 215(2) being for example associated with the multi-dose compartment 220(2)). Each channel 215(1),215(2) is preferably adapted to channel water and/or one or more treatment agent doses towards a region of the drawer seat 120 that allows a mixture between the water and the treatment agent dose(s) (hereinafter referred to as mixing region): the mixing region may for example be or comprise a bottom wall 220(BW) of the drawer seat 120 (visible in FIG. 2B), the bottom wall 220(BW) of the drawer seat 120 being advantageously slanted in order to promote a flow of the mixture between the water and the treatment agent dose(s) towards the treatment chamber of the laundry appliance 100. Advantageously, the channels 215(1),215(2) (or at least one thereof) extend vertically with respect to the rest surface (such as the floor) on which the laundry appliance 100 rests in operation (the channels 215(1),215(2) thus extending substantially along direction z). In alternative embodiments of the present invention, the channels 215(1), 215(2) (or at least one thereof) are inclined with respect to the rest surface (such as the floor) on which the laundry appliance 100 rests in operation. Regardless of the specific (vertical or inclined) orientation of the channels 215(1),215(2), which is not limiting for the present invention, each channel 215(1),215(2) is structured and shaped such as to allow the water and/or the treatment agent dose(s) to fall towards the mixing region of the drawer seat 120 by gravity; in order to achieve it, each channel 215(1),215(2) advantageously comprises a top channel input for receiving the water from a water distribution system above it (not illustrated) and a bottom channel output facing the bottom wall 220(BW) of the drawer seat 120; in operation the bottom channel outputs of the channels 215(1),215(2) are arranged for delivering the water and the treatment agent dose(s) to the bottom wall 220(BW) of the drawer seat 120, and hence to the treatment chamber of the laundry appliance 100. Having two separate channels 215(1),215(2) each one associated with a respective multi-dose compartment 220(1),220(2) is particularly advantageous in the preferred embodiment herein considered in which the multi-dose compartments 220 (1),220(2) store different types of treatment agents (e.g., liquid washing detergent and liquid softener); in fact, in this way, a mixing between the two different types of treatment agents due to the presence of treatment agent residues from channel walls is avoided;

behind the channels 215(1),215(2), and hence in the drawer body 210, one or more (two, in the example at issue) pump actuation parts 225(1),225(2) of the pumping system. The pump actuation parts 225(1),225(2) preferably have suction sides in fluid communication with the multi-dose compartments 220(1),220(2) for drawing up the treatment agent dose(s) therefrom, and delivery sides in fluid communication with the channels 215(1),215(2) for delivering the treatment agent dose(s) thereto. Preferably, as herein assumed, the pump actuation part 225(1) is associated with the multi-dose compartment 220(1) and with the channel 215(1) (it meaning that the suction and delivery sides of the pump actuation part 225(1) are in fluid communication with the multi-dose compartment 220(1) and with the channel 215(1), respectively), and the pump actuation part 225(2) is associated with the multi-dose compartment 220(2) and with the channel 215(2) (it meaning that the suction and delivery sides of the pump actuation part 225(2) are in fluid communication with the multi-dose compartment 220(2) and with the channel 215(2), respectively). According to an exemplary embodiment of the present invention, the suction sides and the delivery sides of the pump actuation part 225(1),225(2) comprise suction and delivery pipes in the form of deformable tubes, and each pump actuation part 225(1),225(2) preferably comprises a peristaltic rotor adapted to hydraulically cooperate with the respective deformable tubes for allowing the fluid (i.e., the laundry treatment agent dose(s)) in the deformable tubes to move during the rotation of the peristaltic rotor.

As visible in the figures, the pump actuation parts 225(1), 225(2) are advantageously housed in a corresponding pump housing 228 on the rear portion of the drawer 115 (rear with respect to the drawer front along direction x).

When the drawer 115 is in the retracted position, the pump actuation parts 225(1),225(2) are adapted to mechanically couple with one or more electrically-operated pump driving parts (preferably provided in the drawer seat 120) of the pumping system, upon said mechanical coupling the electrically-operated pump driving parts allowing driving of the pump actuation parts 225(1),225(2), such as rotating the peristaltic rotor thereof.

According to the preferred embodiment of the present invention herein considered and illustrated, the drawer 115 also comprises one or more (two, in the example at issue) drawer compartments 230(1),230(2) each one adapted to contain a single dose of a respective treatment agent for performing a single washing cycle, hereinafter referred to as mono-dose compartments 230(1),230(2); just as an example, the mono-dose compartment 230(1) may be arranged to contain a single dose of a powder or liquid washing detergent, whereas the mono-dose compartment 230(2) may be arranged to contain a single dose of a powder or liquid or pearl softener.

Preferably, the mono-dose compartments 230(1),230(2) are, along direction x, between the handle 205 and the multi-dose compartments 220(1),220(2). More preferably, the mono-dose compartments 230(1),230(2) are formed in a region of the drawer body 210 that, when the drawer handle 205 is mounted on the drawer body 210, is proximal to the drawer handle 205 (hereinafter referred to as front region of the drawer body 210), whereas the multi-dose compartments 220(1),220(2) are formed in a region of the drawer body 210 (hereinafter referred to as rear region of the drawer body 210) that, along direction x, is rearward with respect to the front region of the drawer body 210.

The already mentioned water distribution system may advantageously comprise a water duct system forming a top 255 of the drawer seat 120 (see FIG. 2C), thus allowing the water to be fed to the channels 215(1),215(2) (and/or to the mono-dose compartments 230(1),230(2), when provided) from above. For example, such water duct system may be provided with water output ends (not visible in figures) which are arranged to be located above the channels 215(1),215(2) (and also above the mono-dose compartments 230(1), 230(2), when provided) when the drawer 115 is in the retracted position.

As mentioned above, the pump actuation part 225(1),225(2) of the pumping system is adapted to mechanically couple, in the retracted position of the drawer 115, with respective one or more electrically-operated pump driving parts (for example, with a respective electrically-operated pump driving part) of the pumping system provided in the drawer seat 120 for allowing driving of the pump actuation part 225(1),225(2).

Each electrically-operated pump driving part may for example comprise a pump electric motor 245(1),245(2) (the electric motor 245(1) being visible in FIGS. 2D, 2E) selectively actuatable (e.g., by means of a washing cycle control system and of an electric power supply unit of the laundry appliance control system) for operating the respective pump actuation part 225(1),225(2) (in alternative embodiments of the present invention, a single electric motor may be provided in order to selectively operate both the pump actuation part 225(1),225(2)), and an output shaft 245(S1), 245(S2) (the output shaft 245(S1) being visible in FIGS. 2D, 2E) adapted to be fitted into a corresponding seat 225(S1), 225(S2) of the respective pump actuation part 225(1),225(2). Advantageously, the output shaft 245(S1), 245(S2) and the respective seat 225(S1), 225(S2) of the pump actuation part 225(1),225(2) have mutually complementary shapes (the output shaft 245(S1), 245(S2) having for example a multi-lobed shape or a star shape), so as to couple or engage with each other when the drawer 115 is moved to the retracted position. More advantageously, each seat 225(S1), 225(S2) is torsionally supported by the pump actuation part 225(1),225(2), whereby the coupling between each output shaft 245(S1), 245(S2) and the respective seat 225(S1), 225(S2) takes place in a dampened manner and even if their complementary shapes are not perfectly aligned when drawer 115 is pushed to the retracted position. According to an embodiment of the invention, each seat 225(S1), 225(S2) is torsionally supported by the peristaltic rotor included in the respective pump actuation part 225(1),225(2)). In this way, when an output shaft 245(S1), 245(S2) is engaged with the corresponding seat 225(S1), 225(S2) (i.e., when the drawer 115 is in the retracted position), the corresponding pump electric motor 245(1),245(2) could transfer rotational movement to the peristaltic rotor.

The pump housing 228 comprises on a rear face 228(R) substantially parallel to directions y and z and which in operation faces the rear portion of the drawer seat 120 (i.e., where the electric motors 245(1),245(2) are located) with openings 228(O1), 228(O2) through which the output shafts 245(S1), 245(S2) of the electric motors 245(1),245(2) are able to pass for being coupled with the pump actuation parts 225(1),225(2) (particularly, with the seats 225(S1), 225(S2) thereof).

The electric motors 245(1),245(2) are advantageously enclosed in a motor shell 250, preferably fixed on the drawer seat 120 (and, hence, separate from drawer body 210) and facing the rear portion of the drawer 115. The motor shell 250 has a front face 250(F) that faces in operation the rear face 228(R) of the pump housing 228. The front face 250(F) of the motor shell 250 is preferably provided with openings 250(O1), 250(O2) through which the output shafts 245(S1), 245(S2) of the electric motors 245(1),245(2) project: in this way, when the drawer 115 is moved to the retracted position (i.e., towards the motor shell 250), the output shafts 245(S1), 245(S2) of the electric motors 245(1),245(2) engage the pump actuation parts 225(1),225(2), thus allowing mechanical coupling therebetween.

Figure 3A:
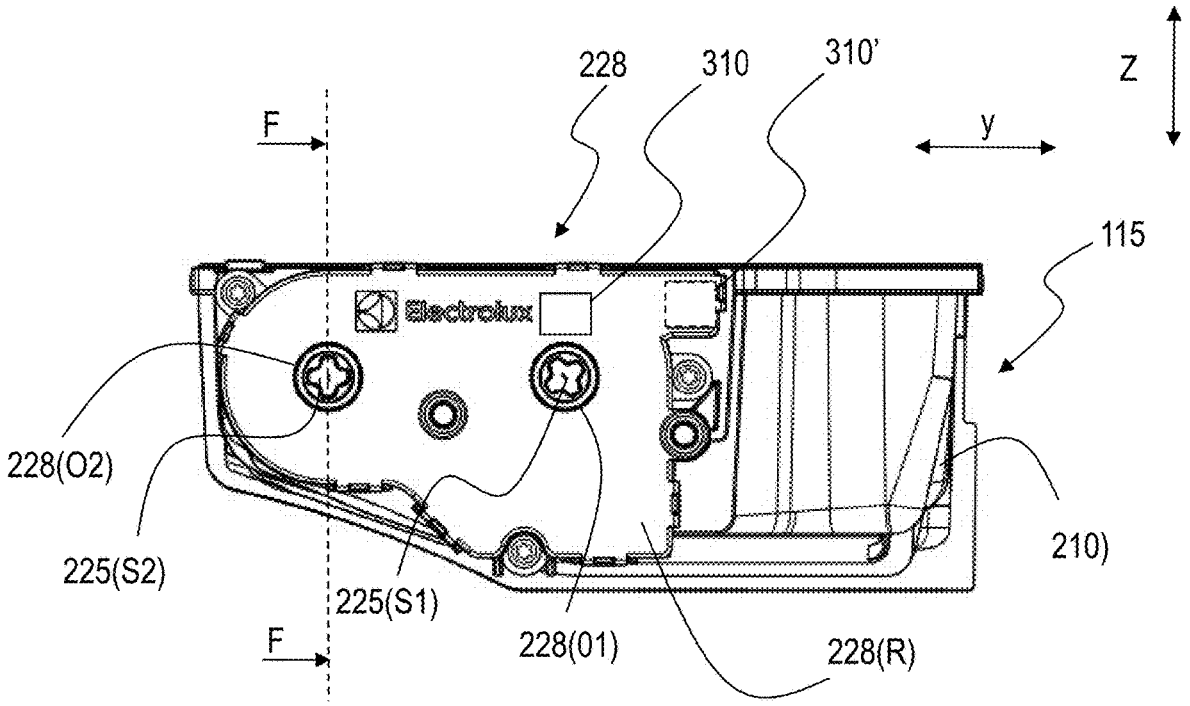
FIG. 3A is a rear view of the drawer of the drawer of FIGS. 2A and 2B.
Figure 3B:
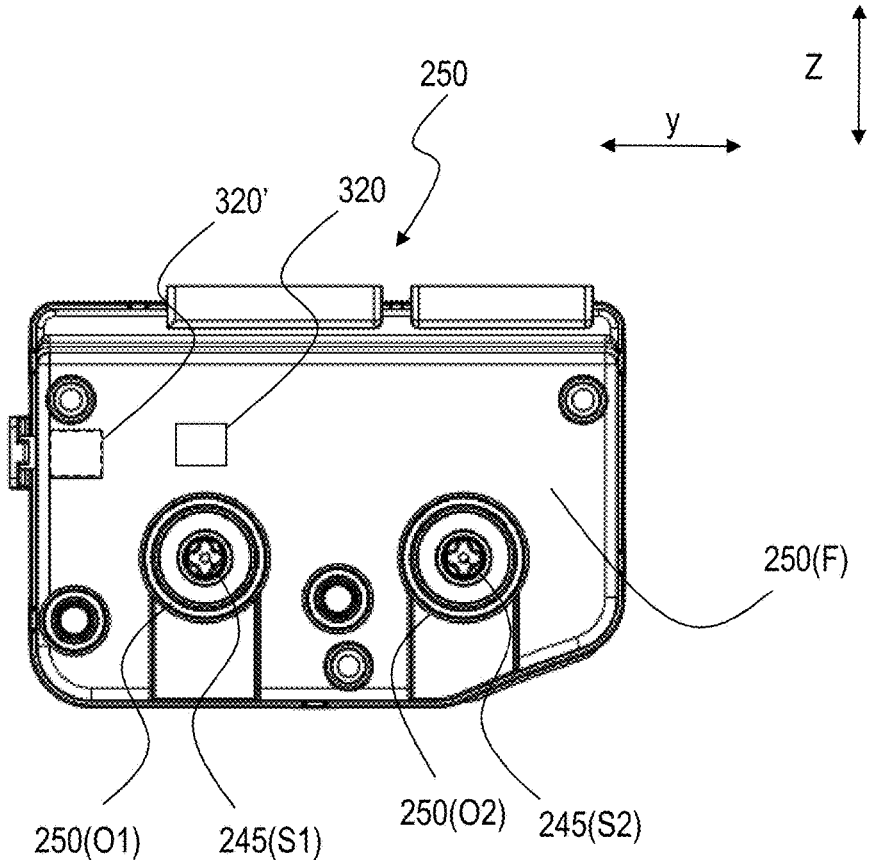
FIG. 3B is a front view of a motor shell included in the drawer seat according to an embodiment of the present invention.

FIG. 3A is a rear view of the drawer 115 taken from a plane parallel to directions y and z in which the pump housing 228 is visible in great detail, while FIG. 3B is a detailed front view of the motor shell 250 taken from a plane parallel to directions y and z.

Returning back to FIG. 2C, the drawer 115 preferably comprises a drawer body cover 210(C) for covering the drawer body 210. More preferably, the drawer body cover 210(C) is configured to cover the rear region of the drawer body 110 in correspondence of the multi-dose compartments 220(1),220(2), thus leaving uncovered both the channels 215(1),215(2), and particularly the top channel inputs thereof (which can therefore be accessed by water fed by the water distribution system) and the front region of the drawer body 210 (and hence the and mono-dose compartments 230(1),230(2), which can therefore be directly accessed from above for loading the treatment agents therein).

Even more preferably, the drawer body cover 210(C) comprises one or more access openings, not shown, each one for accessing a respective multi-dose compartment 220(1),220(2) for loading the treatment agent therein; in the example at issue in which the drawer body 210 comprises two multi-dose compartments 220(1),220(2), two access openings are provided in the drawer body cover 210(C).

Preferably, one or more access components may be provided for selectively covering and uncovering the access openings thereby respectively preventing and allowing access to the respective multi-dose compartments 220(1), 220(2) (in the exemplary considered embodiment, no access components are provided for selectively covering and uncovering the mono-dose compartments 230(1),230(2), however this should not be construed as a limitation). As visible in FIG. 2C, the access components comprises a single door 210(D), for example a flap door pivotally coupled to the drawer body cover 210(C) so as to be actuatable by the user between an open position and a closed position for jointly uncovering and covering, respectively, both the access openings—in any case, in alternative embodiments of the present invention, not shown, two doors may be provided, each door being for example associated with a respective access opening, and hence with a respective multi-dose compartment 220(1),220(2).

According to an embodiment of the present invention, the laundry appliance 100 further comprises a drawer position detecting system for detecting when the position of the storage drawer is in the retracted position.

According to an embodiment of the present invention, the drawer position detecting system comprises a target element 310 and a sensor element 320 configured to sense a proximity of the target element 310 to the sensor element 320.

According to an embodiment of the present invention, the target element 310 is located on the drawer 115 and the sensor element 320 is located on the cabinet 105, such as for example on the drawer seat 120.

Preferably, the target element 310 is located on the rear face 228(R) of the pump housing 228, while the sensor element 320 is located on the front face 250(F) of the motor shell 250. In the embodiment of the invention illustrated in the figures, the target element 310 is located on a portion of the rear face 228(R) of the pump housing 228 which is above the opening 228(O1) (see FIG. 3A), and the sensor element 320 is located on a portion of the front face 250(F) of the motor shell 250 which is above the opening 250(O1) (see FIG. 3B). In this way, the target element 310 and the sensor element 320 are advantageously aligned along a direction parallel to the sliding direction, so that the variation of the distance between the target element 310 and the sensor element 320 caused by a variation of the drawer 115 position with respect to the seat 120 along the sliding direction is directly proportional to such drawer 115 position variation.

In any case, the concepts of the present invention can be also applied to cases in which the target element 310 is located on a different portion of the rear face 228(R) of the pump housing 228 (e.g., in a lateral portion thereof, identified in FIG. 3A with reference 310'), and the sensor element 320 is located on a different portion of the front face 250(F) of the motor shell 250 (e.g., in a lateral portion thereof, identified in FIG. 3B with reference 320').

Furthermore, similar considerations apply also in case the target element 310 and the sensor element 320 are not aligned along a direction parallel to the sliding direction, and/or if the sensor element 320 is located on the drawer 115 while the target element 310 is located on the cabinet 105, such as for example on the drawer seat 120.

The drawer positioning system allows to advantageously detect the mutual position between the drawer 115 and the drawer seat 120 (and, therefore, assess whether the drawer 115 is in the retracted position or not) based on the sensed proximity (or the absence thereof) of the target element 310 to the sensor element 320. More specifically, according to an embodiment of the present invention, the drawer position detecting system is configured to assess that the storage drawer 115 is in the retracted position when the sensor element 320 senses that the target element 310 is in proximity to the sensor element 320.

According to an embodiment of the present invention, the drawer positioning system is configured to assess that the target element 310 is in proximity to the sensor element 320—and then to assess that the drawer 115 is in the retracted position—when the sensor element 320 senses that the distance between the target element 310 and the sensor element 310 corresponds to a predefined distance PD.

FIGS. 2D and 2E show how the distance (identified with reference D) between the target element 310 and the sensor element 320 varies between the condition in which the drawer 115 in the retracted position (FIG. 2D) and the condition in which the drawer 115 is in the extracted position (FIG. 2E), according to an exemplary embodiment of the present invention. As can be seen in FIG. 2D, according to this exemplary embodiment of the invention, the distance D between the target element 310 and the sensor element 320 when the drawer 115 is in the retracted position is very small, since in this condition the target element 310 and the sensor element 320 are very close to each other. In this case, the abovementioned predefined distance PD has a very low value, close to zero.

However, similar considerations apply in case the predefined distance PD has a greater value, such as for example in case the target element 310 and the sensor element 320 are positioned in different positions, such as for example not aligned along the sliding direction and/or not located on the rear face 228(R) of the pump housing 228 and/or not located on the front face 250(F) of the motor shell 250. Moreover, the concepts of the present invention apply in case one between the target element 310 and the sensor 320 is located in a portion of the cabinet 105 different than the drawer seat 120.

According to an embodiment of the present invention, the target element 310 is a magnet, and the sensor element 320 is a magnetic sensor (such as a Hell effect magnetic sensor) adapted to measure the magnetic flux density generated by the target element 310. In this exemplary embodiment, the drawer positioning system is configured to obtain an indication of the distance D between the target element 310 and the sensor element 320 by evaluating the magnetic flux density measured by the sensor element 320, since the closer the target element 310 to the sensor element 320, the higher the magnetic flux density measured by the sensor element 320.

In any case, the concepts of the present invention can be also applied to other kinds of sensor elements 320 which are capable of assessing the distance between the target element 310 and the sensor element 320 itself by measuring another physical quantity, such as for example light intensity emitted by a light emitting target element in case of an optical sensor.

According to an embodiment of the present invention, the drawer positioning system is configured to assess that the actual distance D between the target element 310 and the sensor element 320 corresponds to the predefined distance PD when the actual distance D is such that the physical quantity measured by the sensor element 320 falls below a corresponding threshold. Making for example reference to the case in which the target element 310 is a magnet, and the sensor element 320 is a magnetic sensor, the drawer positioning system may be configured in such a way to assess that the drawer 115 is in the extracted position when the magnetic flux density measured by the sensor element 320 has a value lower than a threshold, and to assess that the drawer 115 is in the retracted position when such measured magnetic flux density reaches and/or surpass such threshold.

According to a preferred embodiment of the present invention, the laundry appliance 100 further comprises a blocking system configured to block in a releasable manner the drawer 115 within the drawer seat 120 when the drawer 115 is in the retracted position.

Figure 4A:
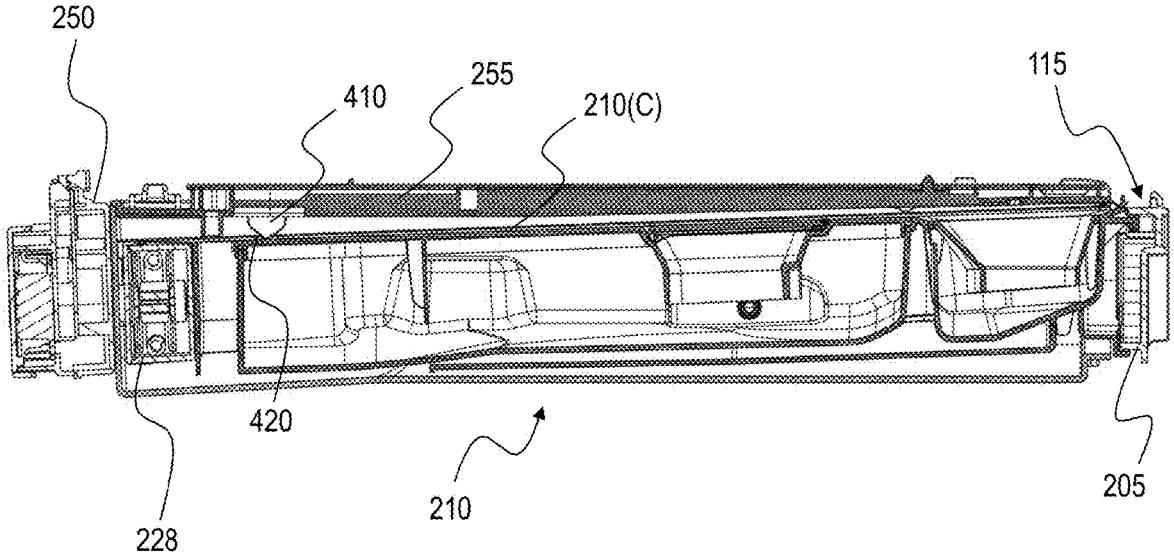
FIGS. 4A and 4B are further section views of the drawer of the previous drawings in the retracted position and extracted positions, respectively.
Figure 4B:
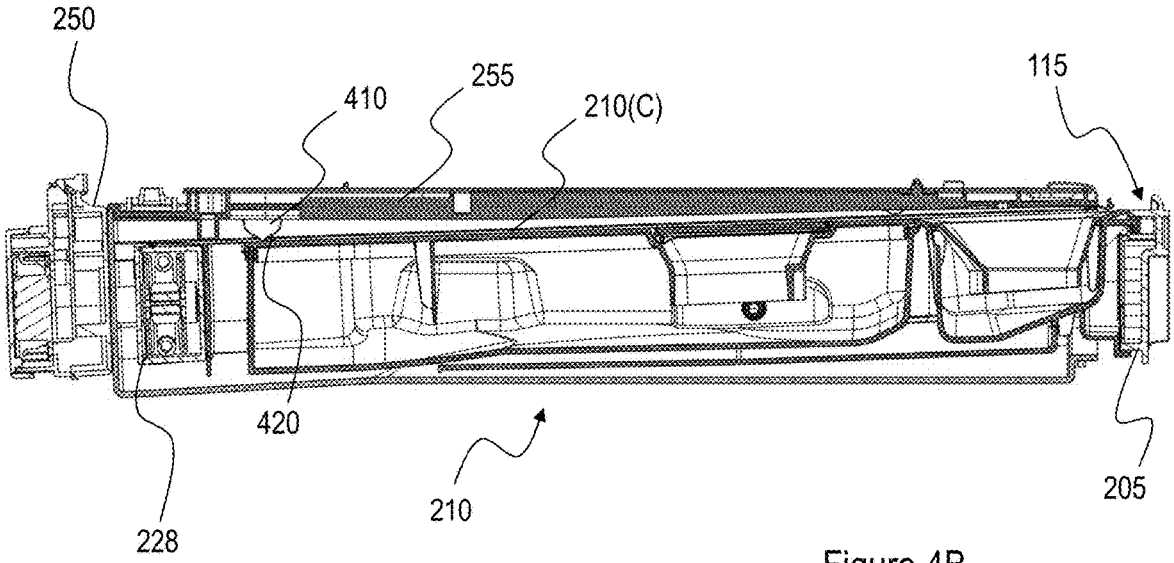

An example of the blocking system according to an embodiment of the present invention is illustrated in FIGS. 4A and 4B, which are section views of the drawer 115 housed in the drawer seat 120 along a plane parallel to directions x and z and passing through section line F-F of FIG. 3A (wherein FIG. 4A shows the drawer 115 in the retracted position, while FIG. 4B shows the drawer in the extracted position).

According to the exemplary embodiment of the invention illustrated in FIGS. 4A and 4B, the blocking system comprises a first tooth member 410 provided on a bottom face of the water duct system forming the top 255 of the drawer seat 120 and preferably protruding downwardly along a direction substantially parallel to direction z. The blocking system further comprises a second tooth member 420 provided on the drawer body cover 210(C) covering the drawer body 210 of the drawer 115 and preferably upwardly protruding along a direction substantially parallel to direction z.

The first tooth member 410 is configured to engage in a releasable way the second tooth member 420 when the drawer 115 is in the retracted position (see FIG. 4A), and disengage from the second tooth member 420 when the drawer 115 is in the extracted position (see FIG. 4B).

When the drawer 115 is moved along the sliding direction by a user from the extracted to the retracted position, the user is advantageously informed of the reaching of the retracted position by the "snap effect" caused by the first tooth member 410 that engages the second tooth member 420.

According to an embodiment of the present invention, the drawer position detecting system is configured so that the sensor element 320 is arranged to sense that the distance D between the target element 310 and the sensor element 320 corresponds to the predefined distance PD when the blocking system is blocking the drawer 115 in the retracted position.

According to an embodiment of the present invention, the drawer position detecting system is arranged to sense that the distance D between the target element 310 and the sensor element 320 corresponds to the predefined distance PD when the first tooth member 410 is engaging the second tooth member 420.

Similar considerations apply in case, instead of tooth members, the blocking system comprises different kind of locking members adapted to engage to each other in a releasable way when the drawer 115 is in the retracted position, such as for example magnetic locking members.

The drawer positioning system according to the embodiments of the invention herein described is able to efficiently detect the position of the drawer 115, and particularly to distinguish between the retracted and the extracted positions, without having to install expensive, complicated and prone to fault detection systems, since only the target element 310 and the sensor element 320 need to be installed.

Moreover, since the target element 310 (e.g., a magnet) is a passive element which does not require to be electrically supplied, the installation of the target element 310 on the drawer is particularly advantageous, since it does not require the installation of electrical wiring on the (movable with respect to the cabinet 105) drawer 115.

Figure 5:
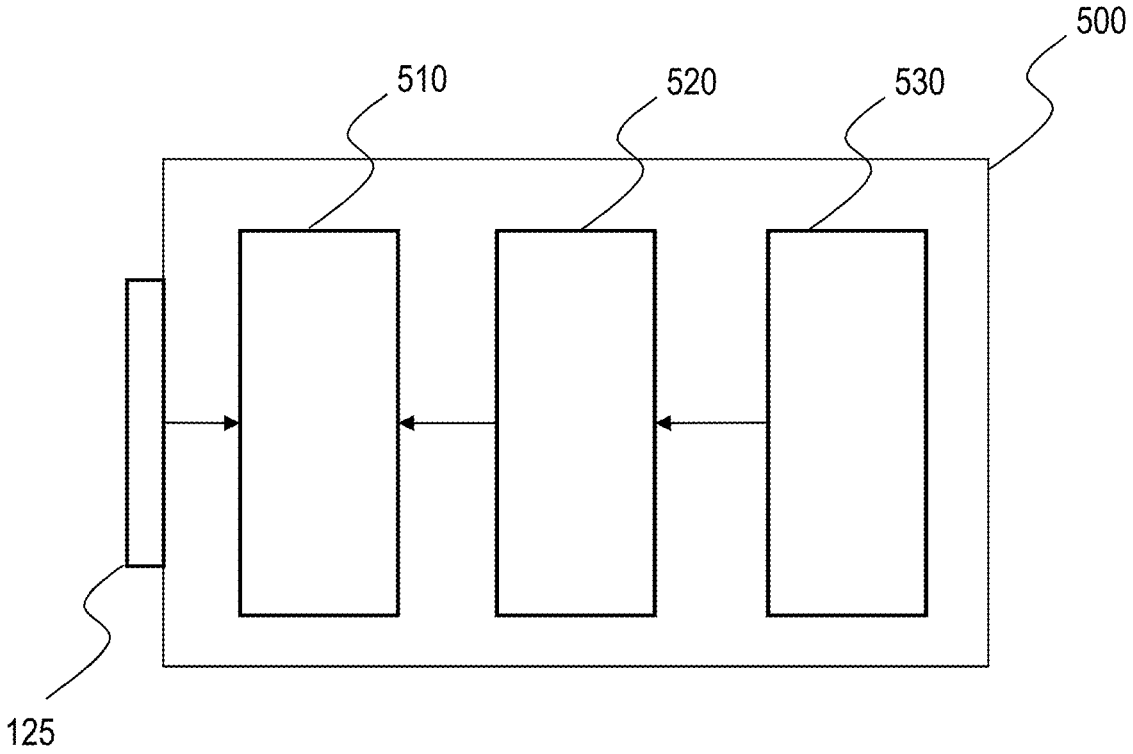
FIG. 5 shows in terms of very general functional blocks a laundry appliance control system according to an embodiment of the present invention.

An example of how the drawer positioning system according to the embodiments of the invention can be advantageously employed will be now described by making reference to FIG. 5, which shows in terms of very general functional blocks the laundry appliance control system, identified in FIG. 5 with reference 500.

As already mentioned above, the laundry appliance control system 500 comprises a washing cycle control system (identified in FIG. 5 with reference 510). The washing cycle control system 510 is configured to drive electrical/electronic/mechanical/hydraulic components of the laundry appliance 100 to trigger the running of a new washing cycle and to perform phases thereof based on commands and parameters inputted by an user through the user interface 125. For example, in response to commands and parameters received through the user interface 125, the washing cycle control system 510 is configured to activate the pump electric motors 245(1),245(2) for operating the respective pump actuation part 225(1),225(2) in order to drawn up doses of laundry treatment agents from the multi-dose compartments 220(1),220(2), and to activate valves of the water distribution system to allow the water duct system forming the top 255 of the drawer seat 120 to fed water to the channels 215(1),215(2).

According to an embodiment of the present invention, the laundry appliance control system 500 further comprises a stand-by system 520 interfaced with the washing cycle control system 510 and with the drawer position detecting system (which in FIG. 5 is part of the laundry appliance control system 500 itself and is identified with reference 530).

According to an embodiment of the present invention, the stand-by system 520 is configured to cause the laundry appliance 100 to enter in a stand-by condition when the drawer position detecting system 530 detects that the drawer 115 is in the extracted position. According to an embodiment of the present invention, the stand-by condition is a condition in which washing cycles are inhibited.

Therefore, according to an embodiment of the present invention, the laundry appliance control system 500 is configured in such a way that:

- when the laundry appliance 100 is in the standard "operative condition", a new washing cycle triggered by the washing cycle control system 510 may be actually carried out;
- when the laundry appliance 100 is instead in the stand-by condition, the running of a washing cycle triggered by the washing cycle control system 510 is prevented, and any already running washing cycle is stopped.

According to an embodiment of the present invention, the stand-by system 520 is further configured to generate an acoustic and/or visual alert when the drawer position detecting system 530 detects that the drawer 115 is in the extracted position. Preferably, said acoustic and/or visual alert is generated only if a washing cycle has been already triggered to be carried out.

The laundry appliance control system 500 according to the embodiments of the present invention is therefore configured to efficiently manage different situations.

For example, if the drawer 115 is opened while a washing cycle is being carried out under the control of the washing cycle control system 510 in response to proper commands sent by the user through the user interface 125, the drawer position detecting system 530 detects that the drawer 115 has assumed the extracted position, and the stand-by system 520 causes the laundry appliance 100 to enter in the stand-by condition. Therefore, the washing cycle is advantageously stopped in an automated way, avoiding to compromise the washing cycle result and preventing spilling of laundry treatment agent and/or water outside of the laundry appliance 100.

Moreover, as long as the laundry appliance 100 is in the stand-by condition because the drawer 115 is detected to be in the extracted position, even if a user is trying to trigger the running of a washing cycle by providing commands through the user interface 125, the washing cycle control system 510 is not enabled to actually start the running of said washing cycle. This is particularly useful in case the user is trying to trigger the running of a washing cycle when the drawer 115 is accidentally left open: in this condition, the stand-by system 520 prevents the washing cycle control system 510 to actual start the running of the washing cycle, and preferably generates an acoustic and/or visual alert to inform the user.

If the drawer position detecting system 530 detects that the drawer 115 passed from the extracted position to the retracted position (for example, because the user pushed it inside the drawer seat 120 after being notified by the acoustic and/or visual alert sent by the stand-by system 520), the stand-by system 520 causes the laundry appliance 100 to exit from the stand-by condition and to enter in the operative condition. Preferably, if the user triggers the running of a washing cycle by providing commands through the user interface 125, the washing cycle control system 510 is allowed to actually start said washing cycle.

Naturally, in order to satisfy local and specific requirements, a person skilled in the art may apply to the invention described above many logical and/or physical modifications and alterations. More specifically, although the invention has been described with a certain degree of particularity with reference to preferred embodiments thereof, it should be understood that various omissions, substitutions and changes in the form and details as well as other embodiments are possible. In particular, different embodiments of the invention may even be practiced without the specific details (such as the numeric examples) set forth in the preceding description for providing a more thorough understanding thereof; on the contrary, well known features may have been omitted or simplified in order not to obscure the description with unnecessary particulars.

The invention claimed is:

1. A laundry appliance, comprising:

a cabinet comprising a laundry treatment chamber and a drawer seat;

a storage drawer comprising at least one compartment for containing a laundry treatment agent, the storage drawer being housed in the drawer seat and slidable with respect to the drawer seat between a retracted position, in which the storage drawer is retracted inside the drawer seat, and an extracted position, in which the storage drawer is at least partially extracted from the drawer seat; and a drawer position detecting system configured to detect when the storage drawer is in the retracted position, said drawer position detecting system comprising a target element and a sensor element configured to sense a proximity of the target element to the sensor element, a first element between said target element and said sensor element being located on the storage drawer and a second element between said target element and said sensor element different than said first element being located on the cabinet.

2. The laundry appliance of claim 1, wherein said second element is located on the drawer seat.

3. The laundry appliance of claim 1, wherein the drawer position detecting system is configured to assess that the storage drawer is in the retracted position when the sensor element senses that the target element is in proximity to the sensor element.

4. The laundry appliance of claim 1, wherein the drawer position detecting system is configured to assess that the storage drawer is in the retracted position when the sensor element senses that a distance between the target element and the sensor element corresponds to a predefined distance.

5. The laundry appliance of claim 4, wherein:

the laundry appliance comprises a blocking system configured to block in a releasable manner the drawer in the retracted position; and the drawer position detecting system is configured so that the sensor element is configured to sense that the distance between the target element and the sensor element corresponds to the predefined distance when the blocking system is blocking the drawer in the retraced position.

6. The laundry appliance of claim 5, wherein:

said blocking system comprises a first locking member located on the storage drawer and configured to engage in a releasable way a corresponding second locking member located on the drawer seat when the storage drawer is in the retracted position, and disengage from the second locking member when the storage drawer is not in the retracted position; and the drawer position detecting system is configured so that the sensor element is configured to sense that the distance between the target element and the sensor element corresponds to the predefined distance when the first locking member is engaged with the second locking member.

7. The laundry appliance of claim 1, wherein said sensor element is a magnetic sensor and said target element is a magnet.

8. The laundry appliance of claim 1, wherein said at least one compartment is configured to contain multiple doses of the laundry treatment agent for performing multiple washing cycles.

9. The laundry appliance of claim 8, wherein the laundry appliance comprises a pumping system configured to take at least one dose of the laundry treatment agent from the at least one container and deliver said at least one dose to the laundry treatment chamber, the pumping system comprising at least one pump actuation part housed in a pump housing located on a rear portion of the storage drawer, and at least one pump electric motor located on a rear portion of the drawer seat so that, when the storage drawer is in the retracted position, the at least one pump electric motor is configured to mechanically couple with the at least one pump actuation part for allowing the pump actuation part to be driven, wherein:

said first element is located at the pump housing, and said second element is located on the motor.

10. The laundry appliance of claim 1, further comprising:

a washing cycle control system configured to trigger the running of washing cycles in response to a command submitted by an user of the laundry appliance; and a stand-by system configured to prevent the running of a washing cycle triggered by the washing cycle control system when the drawer position detecting system detects that the storage drawer is in the extracted position.

11. The laundry appliance of claim 10, wherein the stand-by system is configured to stop an already running washing cycle when the drawer position detecting system detects that the storage drawer is in the extracted position.

12. The laundry appliance of claim 10, wherein the stand-by system is further configured to generate an acoustic and/or visual alert when the drawer position detecting system detects that the position of the storage drawer is in the extracted position.

13. A method for operating a laundry appliance, the laundry appliance comprising a cabinet accommodating a laundry treatment chamber far configured to receive laundry to be treated according to at least one washing cycle, and a storage drawer comprising at least one compartment configured to contain a laundry treatment agent to be used in said at least one washing cycle, the cabinet comprising a drawer seat for configured to slidingly house the storage drawer, the storage drawer being configured to slide with respect to the drawer seat between a retracted position, in which the storage drawer is retracted inside the drawer seat, and an extracted position, in which the storage drawer is at least partially extracted from the drawer seat, the method comprising:

providing a drawer position detecting system for detecting when the storage drawer is in the retracted position, said drawer position detecting system comprising a target element and a sensor element configured to sense a proximity of the target element to the sensor element, a first element between said target element and said sensor element being located on the storage drawer and a second element between said target element and said sensor element different than said first element being located on the cabinet, and operating said drawer position detecting system to detect when the storage drawer is in the retracted position.

14. The method of claim 13, further comprising:

upon detecting that the storage drawer is in the extracted position;

entering the laundry appliance into a stand-by condition in which washing cycles are inhibited.

15. The method of claim 13, further comprising:

performing a washing cycle for treating laundry contained in the laundry treatment chamber in response to a trigger by a user;

entering a stand-by condition upon determining that the storage drawer is in the extracted position; and stopping said running washing cycle upon entering the stand-by condition.

* * * * *